US008565458B2

(12) United States Patent
Eisenberg et al.

(10) Patent No.: US 8,565,458 B2
(45) Date of Patent: Oct. 22, 2013

(54) MEDIA PLAYER AND ADAPTER FOR PROVIDING AUDIO DATA TO HEARING AID

(75) Inventors: Andrew L. Eisenberg, Austin, TX (US); David Matthew Landry, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 242 days.

(21) Appl. No.: 13/039,790

(22) Filed: Mar. 3, 2011

(65) Prior Publication Data

US 2011/0216928 A1 Sep. 8, 2011

Related U.S. Application Data

(60) Provisional application No. 61/310,880, filed on Mar. 5, 2010, provisional application No. 61/318,779, filed on Mar. 29, 2010.

(51) Int. Cl.

| | |
|---|---|
| ***H04R 25/00*** | (2006.01) |
| *H04R 29/00* | (2006.01) |
| *G10L 13/00* | (2006.01) |

(52) U.S. Cl.
USPC ..... 381/315; 381/60; 704/261

(58) Field of Classification Search
USPC ..... 381/312–331, 60
See application file for complete search history.

(56) References Cited

U.S. PATENT DOCUMENTS

| | | | | |
|---|---|---|---|---|
| 5,721,783 | A * | 2/1998 | Anderson | 381/328 |
| 6,620,094 | B2 | 9/2003 | Miller | |
| 6,684,063 | B2 | 1/2004 | Berger et al. | |
| 7,519,194 | B2 | 4/2009 | Niederdrank et al. | |
| 7,529,545 | B2 * | 5/2009 | Rader et al. | 455/432.2 |
| 7,602,929 | B2 | 10/2009 | Topholm et al. | |
| 7,778,432 | B2 | 8/2010 | Larsen | |
| 7,996,040 | B1 | 8/2011 | Timm | |
| 8,014,768 | B2 | 9/2011 | Ackley | |
| 8,072,492 | B2 | 12/2011 | Kondo et al. | |
| 2002/0040254 | A1 | 4/2002 | Neoh | |
| 2003/0045283 | A1 * | 3/2003 | Hagedoorn | 455/426 |
| 2006/0274747 | A1 | 12/2006 | Duchscher et al. | |
| 2007/0183609 | A1 * | 8/2007 | Jenn | 381/312 |
| 2008/0040116 | A1 * | 2/2008 | Cronin et al. | 704/261 |
| 2009/0074216 | A1 * | 3/2009 | Bradford et al. | 381/315 |
| 2010/0054511 | A1 | 3/2010 | Wu et al. | |

FOREIGN PATENT DOCUMENTS

WO WO 2009076949 A1 * 6/2009

OTHER PUBLICATIONS iCom User Guide, Mar. 2010, Phonak AG of Stafa, Switzerland, No. 029-0692-02/V.3.00, Mar. 2010, pp. 1-75.

TV Ears Inc.; "TV Ears, Dr. Recommended TV Listening Devices"; User Manual; 2010; 28 Pages; V 6.10; TV Ears, Inc., USA.

* cited by examiner

*Primary Examiner* — Curtis Kuntz
*Assistant Examiner* — Sunita Joshi
(74) *Attorney, Agent, or Firm* — Lee & Hayes, PLLC

(57) ABSTRACT

A media player includes a processor configured to receive media content from a content source and to process the media content produce an audio signal. The media player further includes a transmitter coupled to the processor and configured to transmit the audio signal to a hearing aid through a communication channel.

18 Claims, 6 Drawing Sheets

MEDIA PLAYER AND ADAPTER FOR PROVIDING AUDIO DATA TO HEARING AID

CROSS REFERENCE TO RELATED APPLICATION(S)

This application is a non-provisional of and claims priority to U.S. Provisional patent application No. 61/310,880, entitled "MEDIA PLAYER CONFIGURED TO COMMUNICATE WITH A HEARING AID," and filed on Mar. 5, 2010, which is incorporated herein by reference in its entirety. Further, this application is a non-provisional of and claims priority to U.S. Provisional patent application No. 61/318,779, entitled "MEDIA PLAYER ADAPTER CONFIGURED TO COMMUNICATE WITH A HEARING AID," and filed on Mar. 29, 2010, which is incorporated herein by reference in its entirety.

FIELD

The present disclosure relates generally to media players, such as television set-top box devices, stereo systems, digital video recorders, and other electronic devices, which are configured to communicate audio data to a hearing aid.

BACKGROUND

Hearing deficiencies can range from partial hearing impairment to complete hearing loss. Often, an individual's hearing ability varies across the range of audible sound frequencies, and many individuals have hearing impairments with respect to only certain frequencies. For example, an individual's hearing loss may be greater at higher frequencies than at lower frequencies.

Hearing aids have been developed to compensate for hearing losses in individuals. Conventionally, hearing aids detects sound with the use of a microphone, which converts the sound into an analog signal. Hearing aids often include an analog-to-digital converter to convert the analog signal into a digital representation, which can be processed by the digital signal processor as programmed by an audiologist. Typically, such programming adjusts the digital representation to compensate for the user's hearing impairments.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

When watching a video or listening to music, decoded audio data is replayed through a speaker associated with a media player (such as a television, a stereo, an MP3 player, or another electronic device) to provide a sound experience for the user. Conventionally, a hearing aid receives the audio output from the speaker, converts the audible sounds into electrical signals, shapes the electrical signals to compensate for the user's hearing deficiency, and reproduces the shaped audio signal at or within the user's ear. However, in some instances, the audio data received by the hearing aid may be distorted by environmental sounds as well as distortion caused by the speaker itself.

Embodiments of systems and methods are disclosed below that deliver audio data directly to the hearing aid through a wireless communication channel. In one embodiment, a media player decodes the audio data and provides the decoded audio data to at least one output (such as an audio output or to a speaker) and provides the decoded audio data to a hearing aid through a wireless communication channel via a wireless transceiver. By utilizing a communication channel between the media player and the hearing aid, the audio data can be delivered directly to the hearing aid and reproduced for the user without noise distortion due to environmental sounds.

Figure 1:
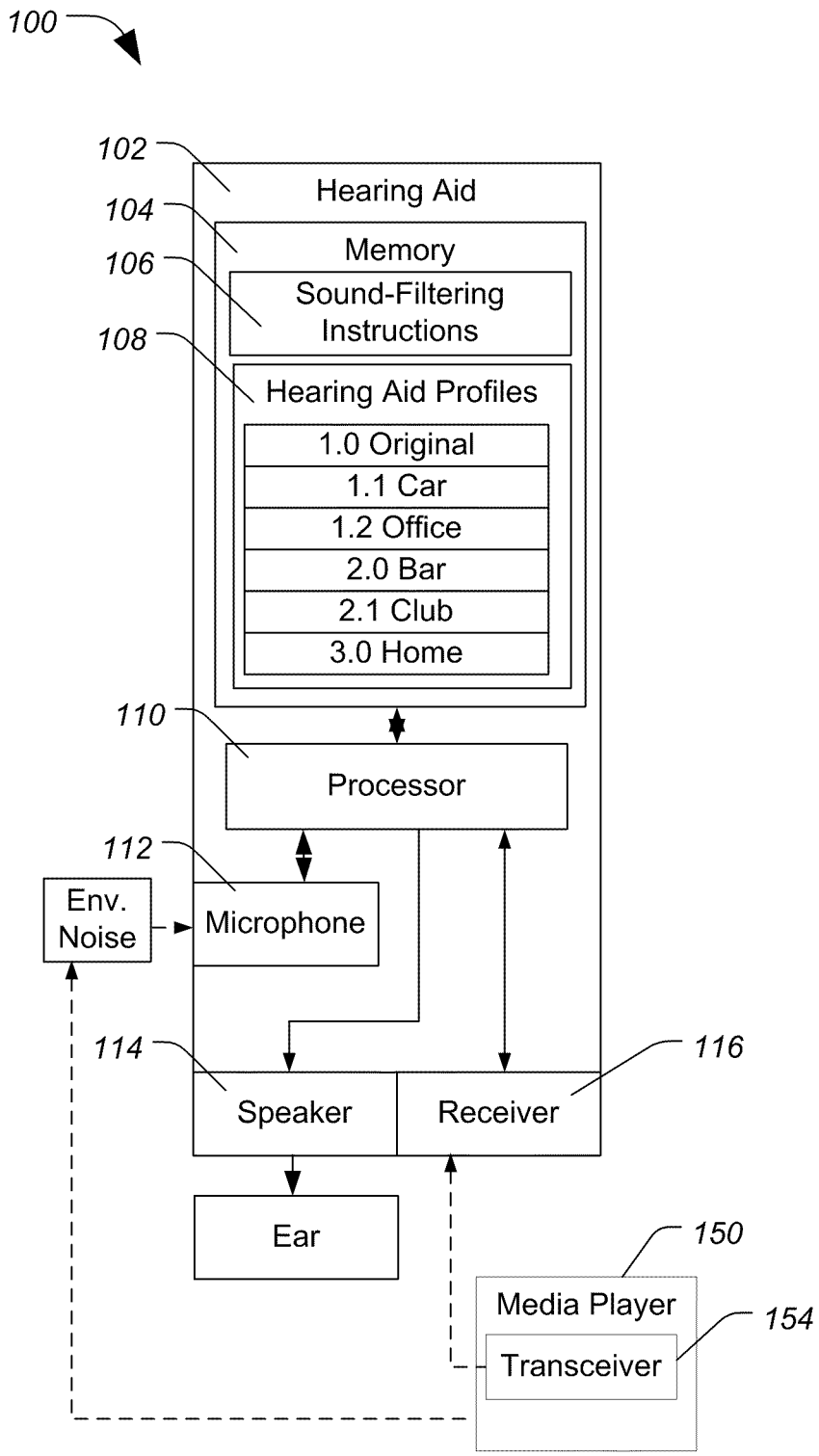
FIG. 1 is a block diagram of an embodiment of a system including a hearing aid, a computing device, and a media player configured to communicate with the hearing aid.

FIG. 1 is a block diagram of a hearing aid system 100 including a hearing aid 102 and a media player 150. Media player 150 may be a television, a set top box (such as a cable set-top box or a satellite receiver), a stereo receiver, a computer, a Moving Picture Experts Group, layer 3 (MP3) player, a mobile phone, a digital video disk (DVD) player, video cassette recorder (VCR), a docking station (for an MP3 player, such as an iPod®), or another media-playing device configured to reproduce media content in an audible and/or visible form. In a particular example, the media player 150 is a music playback device configured to reproduce digitally compressed audio files.

Media player 150 reproduces audio information via an internal speaker or through speakers connected to one of its audio outputs. In some instances, media player 150 also reproduces decoded video information and/or provides the decoded video information to a video output. Media player 150 includes a transceiver 154 configured to negotiate a communication channel with an external device, such as hearing aid 102, and to convert the audio signal into an appropriate format for transmission through the communication channel. The communication channel may include one or more wires or may be a wireless (or radio frequency) communication channel. In a particular embodiment, transceiver 154 is a Bluetooth® transceiver, which can communicate audio data to a Bluetooth® receiver within hearing aid 102, such as receiver 116.

Hearing aid 102 includes a microphone 112 to convert environmental sounds into electrical signals. Hearing aid 102 further includes a processor 110 connected to microphone 112 and to memory 104, which stores sound-filtering instructions 106 and a plurality of hearing aid profiles 108. As used herein, the term "hearing aid profile" refers to a collection of acoustic configuration settings for hearing aid 102, which are used by processor 110 to shape electrical signals related to sounds to compensate for the user's hearing loss. Hearing aid 102 further includes a speaker 114 connected to processor 110 for reproducing shaped audio signals as audible sounds at or within with user's ear. Hearing aid 102 also includes a receiver 116 connected to processor 110 and configured to receive audio data from audio adapter 152 through a wired or wireless communication channel.

In operation, hearing aid 102 receives sounds via microphone 112, which converts sounds into electrical signals and provides the electrical signals to processor 110. Processor 110 applies a selected hearing aid profile 108 to shape and filter the electrical signals to produce modulated electrical signals and provides them to speaker 114. Speaker 114 reproduces the modulated electrical signals as sounds that are compensated for the user's particular hearing deficiencies and/or filtered for the particular acoustic environment.

For example, hearing aid 102 stores multiple hearing aid profiles 108. Each of the hearing aid profiles 108 includes particular settings for shaping the audio signals to enhance the user's hearing within the particular sound environment. In loud environments, such as a bar or a club, hearing aid 102 may apply hearing aid profile "2.0 Bar" or "2.1 Club" to dampen some frequencies while enhancing others.

In an example, media player 150 may be a television that provides an audio output through its speaker and that sends the audio signal to hearing aid 102 via transceiver 154. Hearing aid 102 receives the audible output from the speaker of media player 150 as part of the environmental noise received by microphone 112 as a first input signal. Hearing aid 102 also receives the audio data from media player 150 through the communication channel as a second input signal via receiver 116.

In one particular embodiment, sound-filtering instructions 106 represent a set of equations, coefficients for the equations, algorithms, or any combination thereof that are executable by processor 110 to selectively filter data related to the first input signal based on the second input signal. As used herein, the terms "first" and "second" are not intended to indicate an order of receipt, but rather are used to distinguish between the signals. In one example, processor 110 executes sound filtering instructions 106 to dynamically filter signal content from the first signal from microphone 112 that matches content from the second signal received by receiver 116 to produce a filtered signal. Processor 110 then shapes the filtered signal. In a second example, filtering instructions 106 cause processor 110 to apply a selected hearing aid profile to the second signal from receiver 116 while muting the data received from microphone 112. Once processor 110 has completed the filtering process, processor 110 applies a hearing aid profile 108 to shape the sound for the individual user.

In an alternative embodiment, processor 110 is configurable to apply a first one of the hearing aid profiles 108 to the first input signal from microphone 112 and a second one of the hearing aid profiles 108 to the second input signal from receiver 116. For example, processor 110 may apply a first hearing aid profile to the first input signal to produce a first shaped output signal and a second hearing aid profile to the second input signal to produce a second shaped output signal. Processor 110 selectively provides at least one of the first shaped output signal and the second shaped output signal to speaker 114 to produce an audible signal at or within the user's ear canal.

When processor 110 executes filtering instructions 106, processor 110 may synchronize the contents of the first input signal with content of the second input signal in order to adaptively filter the first input signal to remove audio content from the first input signal that matches audio content of the second input signal. Processor 110 may combine the second signal and the filtered first signal to produce a combined output signal that is shaped according to a hearing aid profile and provided to speaker 114 for playback to the user. By reproducing the second input signal received directly from media player 150 rather than a captured version of that signal from microphone 112, hearing aid 102 produces a better quality audio signal corresponding to the audio output of media player 150. By combining a portion of the first signal with the second input signal, environmental sounds that are unrelated to the media player 150 may still be provided to the user, allowing the user to participate in conversations, to hear the doorbell, or to otherwise enjoy a social experience, while utilizing media player 150.

In some instances media player 150 may be part of a media system, such as a set-to-box (STB) device used to decode an input signal, such as a cable or satellite broadcast signal, which can be connected to a broadcast source via a cable input and to a display, such as a television. In such a case, the receiver or transmitter that broadcasts the audio data to hearing aid 102 may be incorporated in the STB device, as shown in FIG. 2.

Figure 2:
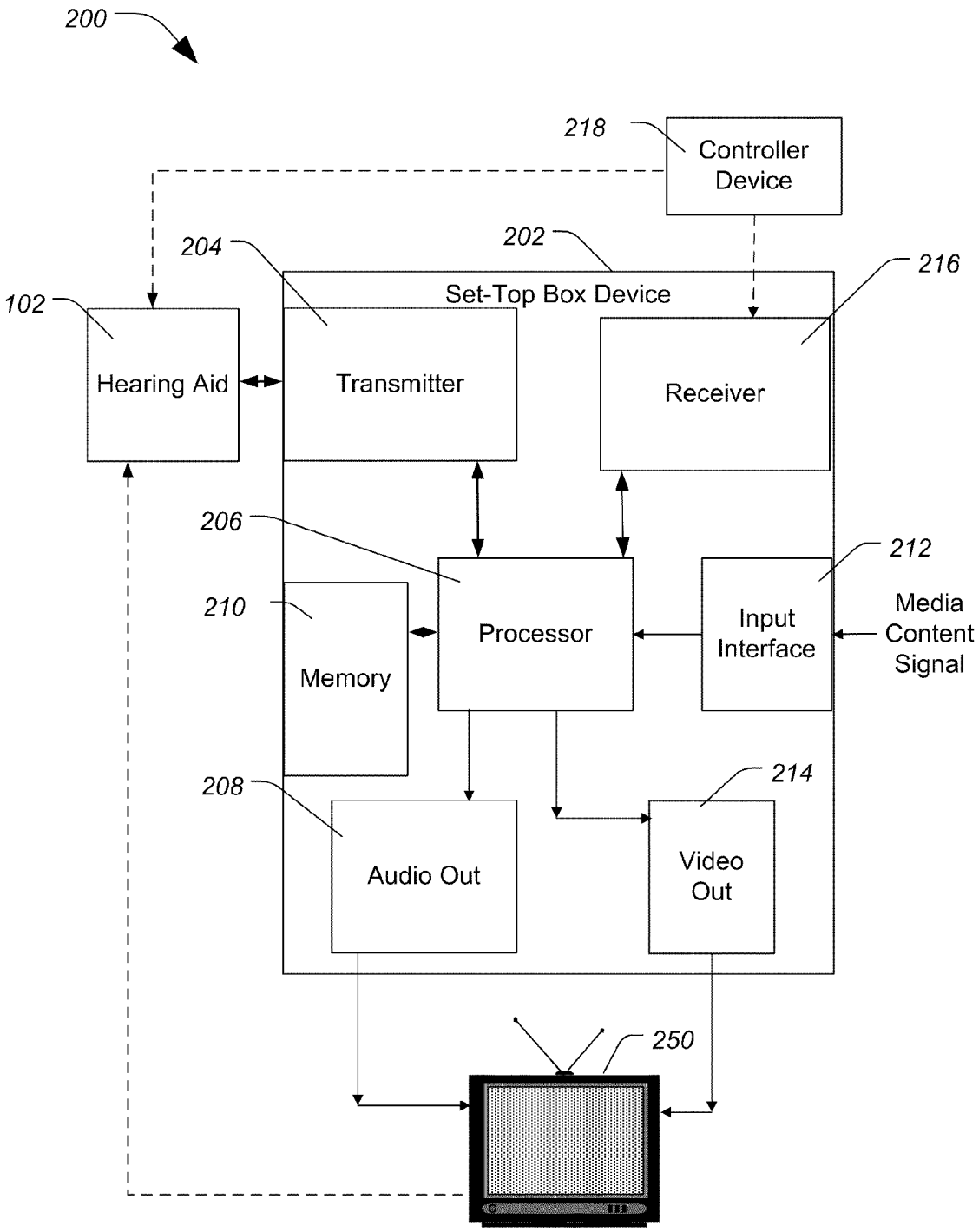
FIG. 2 is a block diagram of an embodiment of a media player adapter configurable to communicate with a hearing aid, such as the media player adapter depicted in FIG. 1.

FIG. 2 is a block diagram of a hearing-aid system 200 including hearing aid 102, television 250, and a set top box (STB) device 202, which is configurable to communicate with hearing aid 102 and with a controller device 218. The controller device 218 may be a remote control. Alternatively, the controller device 218 may be a cell phone or other portable computing device configured to communicate with STB device 202.

STB device 202 includes an input interface 212 that can be coupled to coaxial cable, fiber-optic cable, Ethernet cable, or another network cable or a wireless component to receive encoded media content, such as audio data, video data, or any combination thereof, from a media source, such as a cable television provider, a satellite television provider, a satellite radio provider, or another media source. In some instances, the media content signal may include multiple channels, and STB device 202 is configured to decode the media content signal to extract information related to a selected channel.

STB device 202 includes a processor 206 coupled to the input interface 212 to receive encoded media content. Processor 206 may access instructions stored in memory 210 to decode the encoded media content to produce decoded audio data, which is provided to an audio output 208, and to produce decoded video data, which is provided to a video output 214. Processor 206 is connected to an audio output terminal 208, which is connected to television 250, and to a video output terminal 214, which is connected to television 250. Processor 206 is also connected to a receiver 216, which is configured to receive signals from controller device 218. Additionally, processor 206 is coupled to a transmitter 204 to provide audio data to hearing aid 102 through a communication channel. In an alternative embodiment, processor 206 may be replaced by an audio decoder and video decoder.

Transmitter 204 is configured to communicate with receiver 116 of hearing aid 102. Transmitter 204 may include a wired connection such as a mini stereo plug, a Radio Corporation of America (RCA) connector, a Universal Serial Bus (USB) connector, or another type of connection. Alternatively or in addition, transmitter 204 can include radio frequency transceiver functionality to communicate with hearing aid 102 through a wireless communication channel.

In operation, STB device 202 receives a media content signal at input interface 212. Processor 206 decodes the media content signal to extract a decoded audio signal and a decoded video signal. Processor 206 provides the decoded video signal to video output 214 and provides the decoded audio signal to audio output 208 and to transmitter 204. Transmitter 204 formats and transmits the decoded audio signal to hearing aid 102 though a communication channel.

Hearing aid 102 receives environmental sounds from the speaker of television 250 and audio signals from transmitter 204 through the communication channel. As discussed above with respect to FIG. 1, hearing aid 102 is configured to filter and selectively provide the audio data received from STB device 202 and the audio data from the acoustic environment received from the microphone 112 (shown in FIG. 1) before providing the data to speaker 114.

In an alternative embodiment, transmitter 204 may also be configured to act as a receiver to accept configuration data for the sound signal. Configuration data may be sent directly from hearing aid 102 or from a controller device 218 to STB device 202. If the configuration data is sent from controller device 218, the configuration data is provided to receiver 216 in STB device 202. In one embodiment, controller device 218 (or hearing aid 102) and STB device 202 communicate through a wireless communication channel. It is also contemplated that receiver 216 and transmitter 204 may be combined. In one example, receiver 216 and transmitter 204 may be combined into a single transceiver. In another example, STB device 202 may include multiple transceivers.

The configuration data includes data to program and configure STB device 202, such that STB device 202 can shape sound for the hearing aid user to compensate for the user's hearing deficiency. STB device 202 can be programmed to provide decoded audio data to the television 250 and to shape the decoded audio data before transmitting the audio data to hearing aid 102 via transmitter 204.

In one particular example, the controller device 218 stores a plurality of hearing aid profiles. The user interacts with controller device 218 to select a hearing aid profile and to provide the selected hearing aid profile to the STB device 202 for use in shaping the sound signal prior to transmission to hearing aid 102. The hearing aid profile may be then stored as an operating mode in memory 210. A user may select a desired mode and/or turn on and off the selected mode using a set-top box controller, such as a television remote. In one particular example, STB device 202 may store a plurality of hearing aid profiles and provide a plurality of operating modes with varying sound shaping schemes.

Adapting STB device 202 to receive and apply a custom hearing aid profile allows STB device 202 to provide audio signals that vary from the format received from the external source providing a larger range of usability. For example, STB device 202 may be configured by the controller device 218 to apply specific frequency transforms, provide frequency specific amplitude adjustments, or other known audio adjustments to the audio signal before transmitting through transmitter 204 to hearing aid 102. In this way, STB device 202 provides decoded audio data to television 250 via audio output 208 and provides an individually shaped audio signal to hearing aid 102 directly.

Since the user may have two hearing aids and may have different hearing deficiencies in left and right ears, STB device 202 may include two transmitters 204, where each transmitter is configured to send the appropriate audio data to one of the hearing aids 102.

In an example where the STB device 202 is configured to shape the audio signal before transmitting the audio data to hearing aid 102, hearing aid 102 may receive the environmental sounds including sounds produced by a speaker of television 250 and the transmitted sound data from STB device 202. In this example, hearing aid 102 may mute sounds from its microphone 112 and/or synchronize the audio inputs to provide enhanced sound. However, by moving the processing/shaping of the audio data to STB device 202, the amount of processing performed by hearing aid 102 can be reduced, allowing the hearing aid 102 to simply pass the audio data received from transmitter 204 directly to speaker 114. Additionally, STB device 402 can be configured to provide the shaped audio signal to audio output 208, allowing the user the option of listening to the shaped audio signal while the user's hearing aids are turned off.

In some instances, the media player 150 or television 250 may not include a transceiver. In such an instance, a media player adapter may be provided that can be connected to an audio output and can be configured to communicate the audio data wirelessly to hearing aid 102. An example of a system including a media player adapter is described below with respect to FIG. 3.

Figure 3:
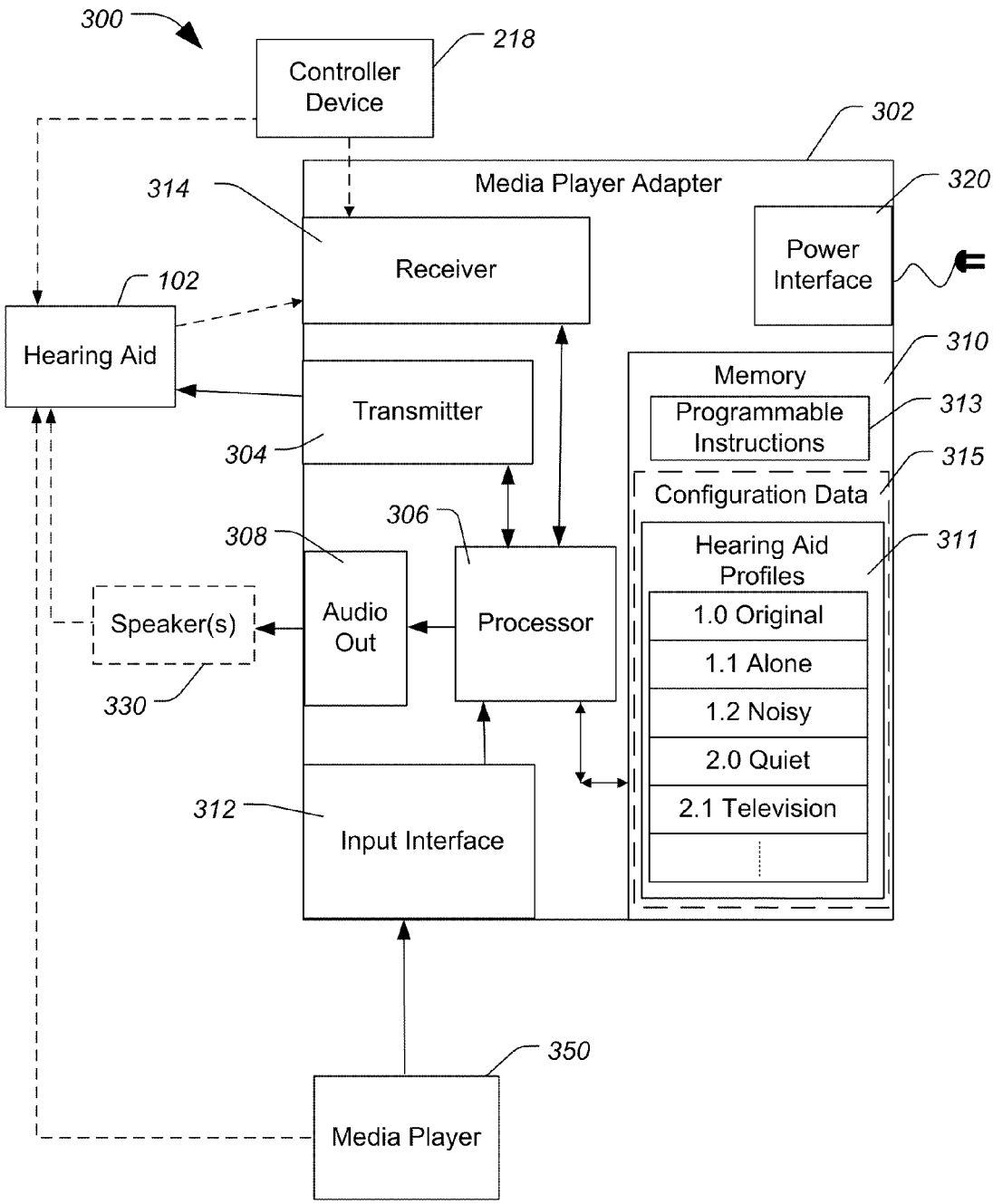
FIG. 3 is a block diagram of another embodiment of a media player adapter including an interface configured to communicate with the hearing aid and a computing device, such as the computing device depicted in FIG. 1.

FIG. 3 is a block diagram of a hearing-aid system 300 including hearing aid 102, media player 150, and an embodiment of media player adapter 352, which is configurable to communicate with hearing aid 102. In the illustrated embodiment, media player adapter 352 includes an input interface 312 that can be coupled to an audio output of media player 150. Input interface 312 may be adapted to receive a mini stereo plug, RCA connector, coaxial or optical digital connector, a universal serial bus (USB) connector, or other connector to receiver an audio signal. Alternatively, input interface 212 may include an antenna receiver for receiving wireless communication from media player 150 or a directional microphone which may be placed in front of a speaker to capture sound before distortion by the environment. By utilizing directional microphone, media player adapter 152 can capture the sound signal produced by media player 150 without having to be coupled to it, particularly useful in hotel or in other environments where the media player 150 does not provide easy connector access. Input interface 312 may also include an analog-to-digital converter (not shown) for converting an analog audio signal into a digital audio signal.

Media player adapter 352 includes a processor 306 coupled to the input interface 312 to receive the media content from media player 150. Media player adapter 352 further includes a transmitter 304 connected to processor 306 to provide audio data to hearing aid 102 through a communication channel. Transmitter 304 is configured to communicate with receiver 116 (depicted in FIG. 1) within hearing aid 102. Transmitter 304 may include a connection interface to receive a wired connector, such as a mini stereo plug, RCA connector, USB connector, or other connector. Alternatively or in addition, transmitter 304 can be a radio frequency transceiver adapted to communicate with hearing aid 102 through a wireless communication channel.

Media player adapter 352 further includes a receiver 314 and a memory 310, which are connected to processor 306. Media player adapter 352 also includes a power interface 320 configured to provide power to the various components of media player adapter 352. Power interface 220 can be configured to connect to a power outlet, such as a plug, to receive a power supply. Additionally, media player adapter 352 includes audio output 308 connected to processor 306. Audio output 308 is configured to connect to one or more speakers 330 and to provide the unmodified audio signal from media player 150 to the one or more speakers 330 for reproduction of an audible output for individuals who are not hearing impaired. Speakers 330 may be connected to audio output 308 through a wired or wireless connection. In an alternative embodiment, speakers 330 may be incorporated into media player adapter 352 or into another device, such as media player 150.

Receiver 314 is configurable to communicate with controller device 218 to receive configuration data 315 and programmable instructions 313. Receiver 314 communicates received data and instructions to processor 306, which can apply the data and instructions to shape audio data and/or store the data and instructions in memory 310.

Controller device 218 can be a cell phone or other portable computing device. Controller device 218 can be accessed by a user to select and communicate configuration data 315 and programmable instructions 313 to receiver 314 through a wired or wireless communication channel to media player adapter 352. The configuration data 315 and hearing aid profiles 311 include data to program and configure media player adapter 352. In particular, the configuration data 315 includes instructions executable by processor 306 to shape sound for the hearing aid user. In one instance, media player adapter 352 can be programmed to shape the audio data using sound-shaping instructions defined by a selected one of the hearing aid profiles 311 before transmitting the audio data to hearing aid 102.

Processor 306 is configured to receive the configuration data 315 including hearing aid profiles 311 from receiver 314. Processor 306 then processes the configuration data 315 and stores the hearing aid profiles in memory 310. Subsequently, processor 306 can apply a selected hearing aid profile to audio data received from input interface 312 to shape the audio data to compensate for the individual's hearing loss before providing the shaped audio data to transmitter 304 for transmission to hearing aid 102 through the communication channel.

In an alternative embodiment, configuration data 315 may be sent directly from hearing aid 102 to media player adapter 352, for example, as during a "hand-shaking" process through which hearing aid 102 and transmitter 304 and/or receiver 314 establish a communication channel. In this instance, hearing aid 102 communicates with receiver 314 though the communication channel to send configuration data 315 and a selected hearing aid profile 311. For example, hearing aid 102 may transfer the currently selected hearing aid profile to media player adapter 352.

In other embodiments, controller device 318 may be used to program media player adapter 352 to apply specific frequency transforms, provide frequency specific amplitude adjustments, or other known audio adjustments to the audio signal before transmitting. This allows media player adapter 352 to provide a plurality of varying audio signals that diverge from the original format provided by media player 150, providing a sound signal to hearing aid 102 that is clearer than that received via microphone 112 (depicted in FIG. 1) within hearing aid 102 and that is already compensated for the user's hearing deficiency. By shifting some of the audio processing out of hearing aid 102 and into the media player adapter 352, power consumption by processor 110 of hearing aid 102 is reduced, extending the battery life of hearing aid 102. Further, configurability of media player adapter 352 makes it possible to provide an individually tuned audio signal to hearing aid 102.

While FIG. 3 provides one embodiment of media player adapter 352 other variations are contemplated. For example, many of the components of media player adapter 352 may be duplicated on controller device 218. Therefore, media player adapter 352 may be implemented as a docking interface for controller device 218. One such embodiment of media player adapter 352 is described below with respect to FIG. 4.

Figure 4:
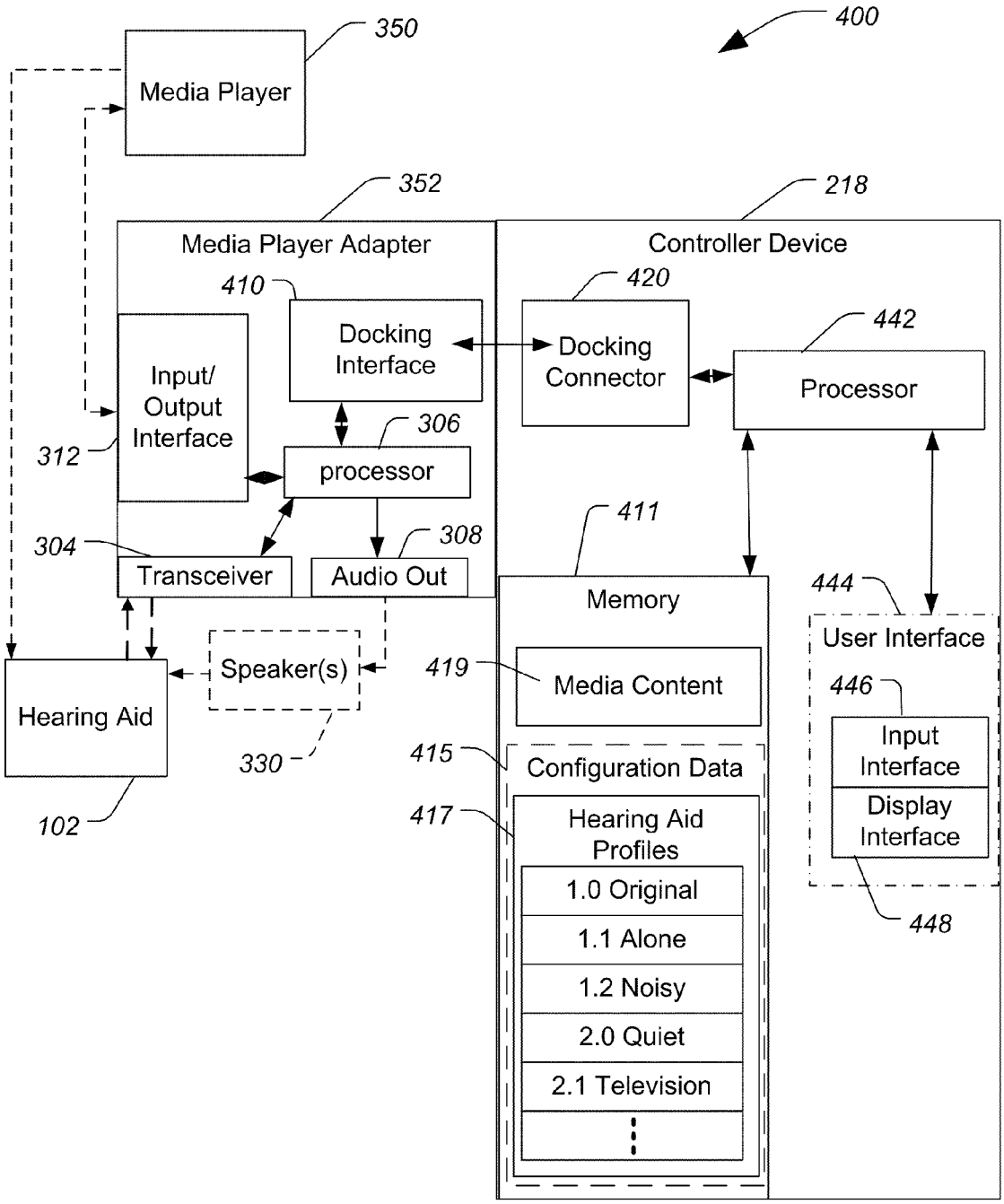
FIG. 4 is a block diagram of an embodiment of a set-top box configurable to decode multimedia information from a broadcast source, to provide the decoded information to a television, and to communicate with a hearing aid, such as the hearing aid depicted in FIG. 1.

FIG. 4 is alternative embodiment of hearing aid system 400 including an embodiment of media player adapter 352 that includes a docking interface 410 that is configured to connect to a docking connector 420 within an embodiment of a controller device 218. Controller device 218 represents one possible embodiment of controller device 218 depicted in FIG. 2. Controller device 218 is typically a computing device, such as a smart phone or PDA, and media player adapter 352 serves as a media docking station for controller device 218.

In the illustrated embodiment, media player adapter 352 includes a media player input/output (I/O) interface 412 that can be coupled to media player 150. Media player (I/O) interface 412 may be adapted to receive a mini stereo plug, RCA connector, USB connector, or other audio, video, or data connector. Media player I/O interface 412 is designed to allow bi-directional communication between media player adapter 352 and media player 150. For example if media player adapter 352 is connected to a television, media player (I/O) interface 412 would allow the transfer of audio signals from the television to adapter 352 and would allow the transfer of user interface or menu data from media player adapter 352 to media player 150 for display. In some instances, media player adapter 352 may provide video signals, audio signals, or both to media player 150 through I/O interface 412.

Media player adapter 352 includes a processor 306 coupled to the media player interface 412 to receive the media content from media player 150 and to provide data to media player 150 for display. Processor 306 is coupled to a transmitter 404 to provide audio data to hearing aid 102 through a communication channel by communicating with receiver 116 within hearing aid 102. Transmitter 404, similar to the audio input interface, may include a wired connection such as a mini stereo plug, RCA connector, USB connector, or other connector. Alternatively or in addition, transmitter 404 can be a radio frequency transceiver adapted to communicate with hearing aid 102 through a wireless communication channel. One example of such a radio frequency transceiver is a Bluetooth® transceiver.

Processor 306 is further coupled to docking interface 410, which is adapted to receive a docking connector 420 of controller device 418. Docking interface 410 and docking connector 420 may include one or more pins, pads, or other conductive leads configured to electrically connect to one another to facilitate data communication between media player adapter 352 and controller device 218. Docking interface 410 and docking connector 420 may also take various wired connections, such as the IPod® 30 pin dock connector for the music player produced by Apple, Inc. of Cupertino, Calif., a mini stereo plug, Radio Company of America (RCA) connector, a universal serial bus (USB) connector, or other connector.

Controller device 218 is connected to media player adapter 352 through docking interface 420 as described above. Controller device 418 may be a computing device, such as a smart phone, personal digital assistant (PDA), a multi-media player such as an MP3 player configured to reproduce audio data, video data, or both, or another type of computing device configured to communicate with hearing aid 102.

Controller device 218 includes a processor 442 coupled to docking interface 420 and to a memory 411, such that processor 442 can access data stored within memory 411 and communicate it to media player adapter 352 through a communication path provided by docking interface 410 and docking connector 420.

Memory 411 is configured to store configuration data 415 and optionally media content 419. Configuration data 415 can include a plurality of hearing aid profiles 417, which are customized for the user to compensate for the user's hearing deficiency. Media content 419 may include one or more audio files, video files, or audio/visual (multi-media) files. For example, media content 419 may be a movie, television show, a music video, a slide presentation, a song, or another type of audio and/or video file.

Control device 218 also includes a user interface 444, which includes a display interface 448 and an input interface 446. Display interface 448 displays information to a user. Input interface 446 can be a key pad, a keyboard, a mouse, a stylus, a touch-sensitive interface (such as a track pad or touch-sensitive surface), or any combination thereof, that is configured to receive input from the user. In some embodiments, a touch screen display may be used, in which case display interface 448 and input interface 446 may be combined to display information and to receive user input responsive to the displayed information. Through user interface 444 the user may edit, create, and select configuration data 415, programmable instructions 413, and media content 419. Programmable instructions 413 and configuration data 415 may be programmed by a user via user interface 444. In this way the user can use controller device 218 to configure hearing aid 102 and media player adapter 352.

Thus through docking interface 410 and docking connector 420, processor 306 in media player adapter 352 can request and access configuration data 415 and media content 419 from memory 411 on controller device 218. Processor 306 may then apply configuration data 415 either to media content 419 or to media content from media player 150 to produce an output signal. The output signal can be transmitted to hearing aid 102 via transceiver 404, to the one or more speakers 430 through audio output 308, and/or to media player 150 through I/O interface 412.

In an alternative embodiment, configuration data 415 may be also stored in internal memory of media player adapter 352, such as memory 310 shown in FIG. 3. In this embodiment, configuration data 315 and programmable instructions 313 in memory 310 may be updated by docking controller device 218 with media player adapter 352 and interacting with user interface 444 to initiate an update process. This alternative embodiment allows the adapter to operate with or without having the controller device 218 docked.

In another alternative embodiment, processor 306 may be omitted, such that processor 442 of controller device 218 may be used by media player adapter 352 in lieu of having its own processor 306. In this embodiment, processor 442 accesses memory 411 and applies the configuration data 415 and the selected hearing aid profile to an audio signal received via I/O interface 412 and provided to controller device 218 through docking interface 410 and docking connector 420. In this instance, I/O interface 412 is directly connected to docking interface 410. Processor 442 can process the audio signal to shape the signal to compensate for the user's hearing deficiencies before providing the shaped signal to transmitter 404 in media player adapter 352.

In another alternative embodiment, processor 306 and 442 may work together to process the audio signal into a shaped audio signal. For example, processor 442 may take over and act as the primary processor when controller device 418 is docked with media player adapter 352. Here, processor 442 may divide the processing tasks between itself and processor 306. In a second example, the reverse may be true and processor 306 may act as the primary processor dividing up tasks between itself and processor 442. In yet another example, media player adapter 352 may pipe line the processing tasks so that certain tasks are performed by processor 442, such as noise cancellation, while processor 306 performs frequency adjustments.

In yet another alternative embodiment, the audio signal may originate from memory 411 in controller device 218. For example, controller device 218 may contain media content 419 in memory 411. In this embodiment, processor 306 receives media content 419 along with configuration data 415 from memory 411 in controller device 218. Processor 306 will shape the audio signal from media content 419 using the configuration data 415 and provide the shaped audio signal to transceiver 404 for transmission to hearing aid 102 and to audio out 308, which will apply the original audio signal to speaker 430. Media content 419 may also contain a video signal which processor 306 can access and provide to media player input/output 412, which will transmit the video data to media player 150.

As discussed above, FIG. 4 depicts media player adapter 352 capable of being a signal source to media player 150 via controller device 218. In such an instance, media player adapter 352 provides media content to media player 150, such as by playing back stored media content 419 from memory 411. Further, while the above-descriptions have focused on a wired connection between the media player 150 and the media player adapter 352, in other embodiments the media player and the media player adapter 352 may communicate wirelessly.

Figure 5:
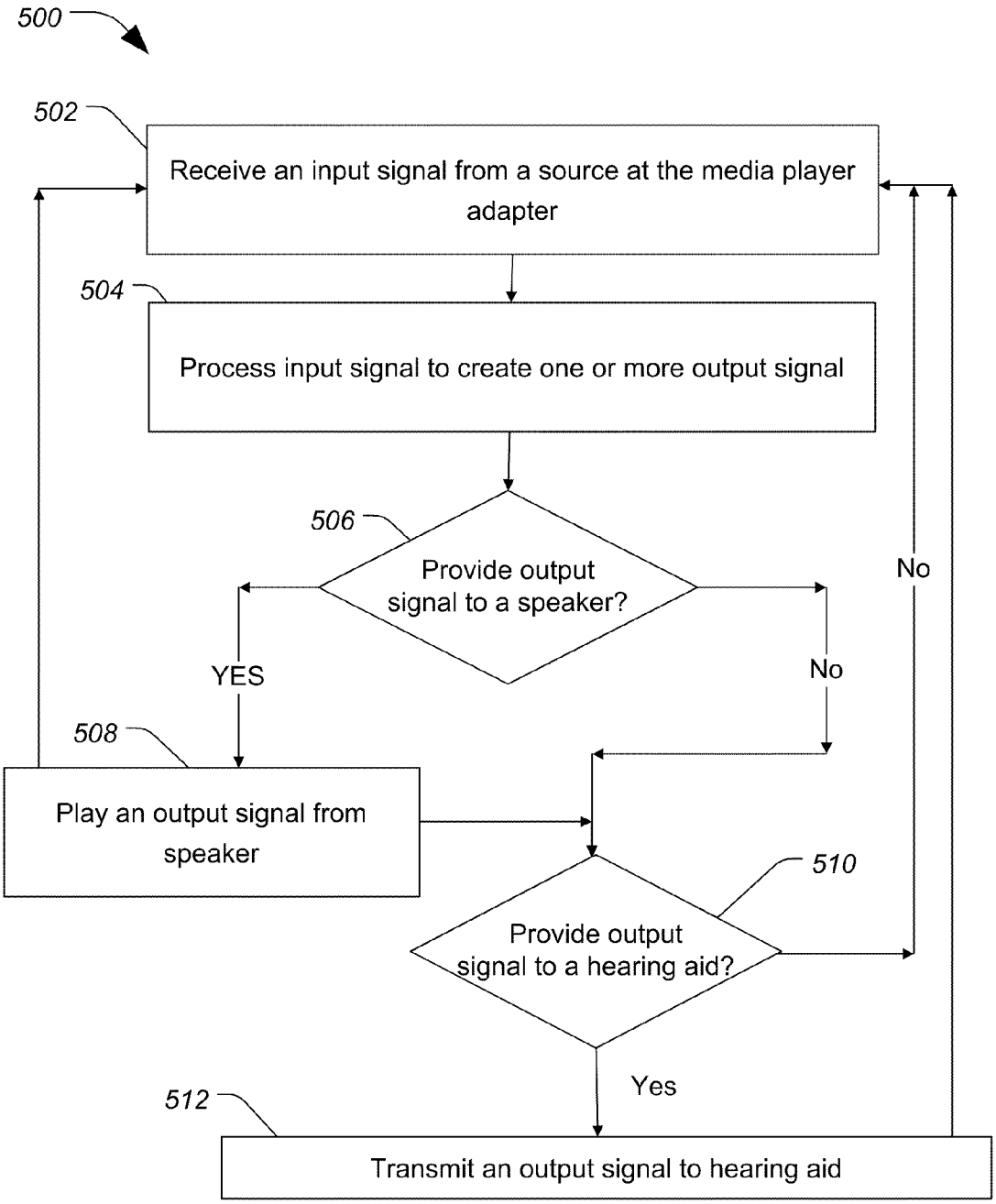
FIG. 5 is a flow diagram of an embodiment of a method of providing audio data to a hearing aid.

FIG. 5 is a flow diagram of an embodiment of a method 500 of providing audio data to hearing aid 102. At 502, media player adapter 352 receives an input signal from a source. The source could be a media player, such as media player 150, a controller device, such as controller device 218, an antenna, or another content source, such as a cable company, an Internet server, or other content source. Advancing to 504, processor(s) (within media player 150, media player adapter 352, or STB device 402) process the input signal to create one or more output signals. Processor(s) may each independently produce the output signal(s) or work in combination to produce the output signal(s). It is also contemplated that the processor(s) could produce more than one output signal for transmission to various devices, such as multiple speakers, multiple hearing aids, or both.

Proceeding to 506, the processor determines whether to provide the output signal to one or more speakers. The output signal to the speaker may differ from the output created for transmission to hearing aid 102 and may simply be a pass through of the input signal. If (at 506) the output signal is to be transmitted to a speaker, method 500 proceeds to 508 and the output signal is provided to a speaker. In some instances, if the output signal is shaped for a hearing aid user by the processor based on a hearing aid profile, the shaped output signal may be provided to the speaker so that the user may not even need a hearing aid to hear the audio output of the speaker. However, if others are in the room, the speaker may play the unshaped output signal to provide the un-shaped sound output. Continuing to 510, if the output signal is to be transmitted to the hearing aid, the method advances to 512 and the output signal is transmitted to the hearing aid.

At 506, if the output signal is not provided to a speaker, the method 500 proceeds to 510 and, if the output signal is to be provided to the hearing aid, the method continues to 512. At 512, the output signal is transmitted to the hearing aid. Otherwise, at 510, if the output signal is not to be provided to the hearing aid, the method 500 returns to block 502.

FIG. 5 provides a flow diagram of the procedure of providing an output signal to a speaker or hearing aid. It should be understood that the blocks of method 500 are illustrative only, and that other steps or operations could be performed and/or selected blocks may be omitted. In an example, in some implementations, decision blocks 506 and 510 can be omitted, and block 508 can be also be omitted. Other arrangements are also possible.

Figure 6:
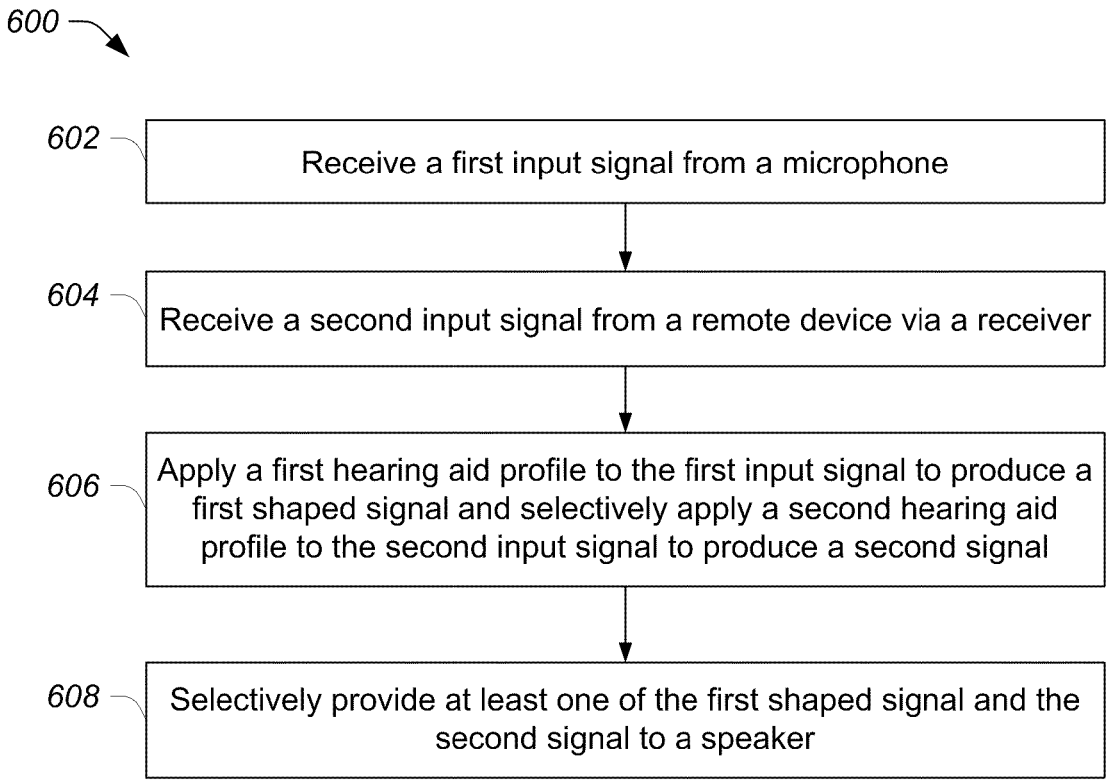
FIG. 6 is a flow diagram of a second embodiment of a method of providing audio data to a hearing aid.

FIG. 6 is a flow diagram of a second embodiment of a method 600 of providing audio data to a hearing aid. At 602, a processor of a hearing aid receives a first input signal from a microphone. The first input signal is an electrical signal representing sounds received by the microphone. Continuing to 604, the processor receives a second input signal from a remote device via a receiver. The remote device may communicate with the receiver via a wireless communication channel.

Proceeding to 606, the processor applies a first hearing aid profile to the first input signal to produce a first shaped signal and selectively applies a second hearing aid profile to the second input signal to produce a second signal. In an example, the second input signal may have already been shaped using a hearing aid profile by a media player, an STB device, a media player adapter or some other device. In this example, the processor shape the first input signal from the microphone and provide the already shaped second input signal to the speaker without further shaping. In another example, sounds received from microphone 112 may require different shaping or filtering from audio data received by receiver 116. In this instance, the processor may apply a first hearing aid profile to the first input signal and a second hearing aid profile to the second input signal.

Continuing to 608, the processor selectively provides at least one of the first shaped signal and the second signal to a speaker of the hearing aid for reproduction at or within the user's ear canal. In a particular instance, the processor selectively combines the first shaped signal and the second signal to produce a composite signal that is provided to the speaker. In conjunction with the systems and methods described above with respect to FIGS. 1-6, an electronic device (such as a media player, a media player adapter, a set-top box device, or some other device) is configured to provide an audio output and to transmit audio data to a hearing aid through a communication channel. Depending on the operating mode, the hearing aid is configured to shape audio data from its microphone using a first hearing aid profile and to selectively shape audio data received by receiver 116 using a second hearing aid profile.

Although the present invention has been described with reference to preferred embodiments, workers skilled in the art will recognize that changes may be made in form and detail without departing from the scope of the invention.

What is claimed is:

1. A set-top box comprising:

a decoder configured to receive media content form a content source and to decode the media content into an audio signal and a video signal;

a video output to output a list of hearing aid profiles stored on the set-top box and the video signal to a display associated with the set-top box;

a receiver configured to receive a selection between a first operating mode, a second operation mode and a third operating mode from a remote control device;

a processor configured to process the audio signal according to a hearing aid profile, in response to receiving the selection, and to produce a modulated audio signal; and a transmitter coupled to the processor and configured to transmit the audio signal to one or more speakers in the first operating mode, the audio signal to the one or more speakers and the modulated audio signal to the hearing aid in the second operating mode and the modulated audio signal to the one or more speakers in the third operating mode.

2. The set-top box of claim 1, further comprising a tuner coupled to the processor, the tuner configured to extract the media content associated with a particular frequency band from a broadcast signal, the tuner to provide the media content to the decoder.

3. The set-top box of claim 1, further comprising a memory coupled to the processor, the memory to store the media content; and wherein the memory is the content source.

4. A media player adapter comprising a receiver configured to receive a selection between a first operating mode, a second operating mode and a third operating mode from a remote control device;

an input configurable to receive media content from a content source and decode the media content into an audio signal and a video signal;

a processor coupled to the transmitter and configurable to apply hearing aid configuration data to the audio signal to produce a shaped audio signal; and a transmitter coupled to the input and configured to send the video signal to a display and the audio signal to one or more speakers in the first operating mode, the audio signal to the one or more speakers and the shaped audio signal to the hearing aid in the second operating mode and the shaped audio signal to the one or more speakers in the third operating mode.

5. The device of claim 4, wherein the content source comprises a media player including an audio output; and wherein the device is an adapter coupled to the audio output of the media player.

6. The device adapter of claim 4, wherein the receiver is configured to receive the selection from at least one of a remote control device, a controller device, a computing device associated with the hearing aid, and the hearing aid.

7. The device of claim 6, wherein the receiver also receives configuration data includes the hearing aid configuration data.

8. The device of claim 4, wherein the content source is a memory coupled to the processor.

9. The device of claim 4, further comprising an audio interface configured to provide the audio signal to an audio device.

10. A media player device comprising an input interface configured to be coupled to a cable to receive media content from a content source;

a decoder to decode the media content into an audio signal;

a receiver configured to receive a a hearing aid profile from a remote control and a selection between a first operating mode, a second operating mode and a third operating mode from the remote control device a memory to store the hearing aid profile;

a processor coupled to the input interface and the memory, the processor configured to enter a hearing aid mode, in response to receiving the hearing aid profile, and while in the hearing aid mode to apply the hearing aid profile to the audio signal to produce a shaped audio signal; and a transmitter coupled to the processor and configured to send the audio signal to one or more speakers in the first operating mode, the audio signal to the one or more speakers and the shaped audio signal to the hearing aid in the second operating mode and the shaped audio signal to the one or more speakers in the third operating mode.

11. The device of claim 10, wherein the device comprises at least one of a cable television set-top box device, a digital video disk (DVD) player, a satellite receiver, a stereo receiver, a digital video recorder (DVR), and a portable music player.

12. The device of claim 10, wherein the device comprises a media player adapter.

13. The device of claim 10, further comprising a docking interface configurable to couple to a docking station.

14. The set-top box of claim 1, wherein the hearing aid enters a low power mode in response to receiving the modulated audio signal from the set-top box.

15. The set-top box of claim 1, wherein remote control provides the selection to the hearing aid, to cause the hearing aid to enter a low power mode.

16. The device of claim 4, wherein the hearing aid enters a low power mode in response to receiving the shaped audio signal from the device.

17. The device of claim 4, wherein the hearing aid filters sound captured by a microphone based on the shaped audio signal.

18. The device of claim 10, wherein the hearing aid enters a low power mode in response to receiving the shaped audio signal from the device.

* * * * *